United States Patent [19]

Hagerman

[11] 3,938,872

[45] Feb. 17, 1976

[54] SHELF RETAINER FOR MOBILE VEHICLE REFRIGERATORS

[76] Inventor: Lynn W. Hagerman, 7236 Burton St., Dublin, Calif. 94566

[22] Filed: Oct. 15, 1974

[21] Appl. No.: 514,765

[52] U.S. Cl. ..... 312/291; 211/105.6

[51] Int. Cl.[2] ..... A47B 96/04

[58] Field of Search ..... 312/291, 292; 5/118; 297/390; 211/184, 105.6

[56] References Cited

UNITED STATES PATENTS

| | | | |
|---|---|---|---|
| 860,348 | 7/1907 | Brayton | 211/105.6 |
| 2,316,710 | 4/1943 | Parke | 5/9 R |
| 2,649,971 | 8/1953 | Marchand | 211/105.6 |
| 2,973,870 | 3/1961 | Schoos | 211/105.6 |
| 3,074,740 | 1/1963 | Zastrow | 211/105.6 |
| 3,695,698 | 10/1972 | Trump | 297/390 |
| 3,752,324 | 8/1973 | Moser | 312/291 |
| 3,757,958 | 9/1973 | Kirkemo | 312/291 |

*Primary Examiner*—Paul R. Gilliam
*Assistant Examiner*—Alex Grosz
*Attorney, Agent, or Firm*—Theodore J. Bielen, Jr.; Richard Esty Peterson

[57] ABSTRACT

A retainer device for refrigerators in mobile vehicles such as campers, trailers, motor homes and boats to prevent articles on the refrigerator shelves from inadvertently and suddenly displacing by motion of the vehicle particularly when the door of the refrigerator is opened, the retainer device comprises a pair of adjustable support members horizontally mounted in a spaced, parallel arrangement across the open front of a refrigerator, the support members have a plurality of interconnecting bands of preferably elastic material vertically positioned against the refrigerator shelves when the article retainer is installed, the interconnecting bands having a plurality of bands of preferably less elastic material horizontally arranged across the vertical bands forming a grid to retain articles on the shelves within the refrigerator.

2 Claims, 4 Drawing Figures

FIG-1
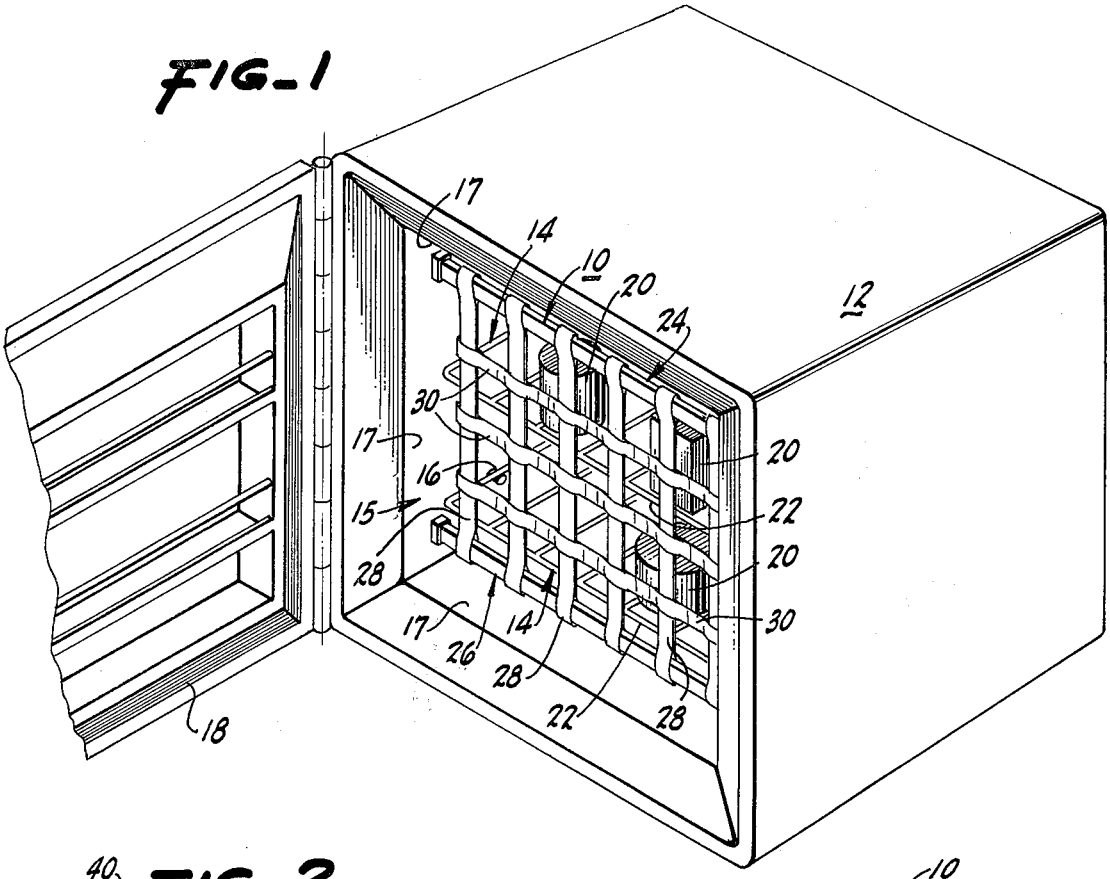
FIG-2
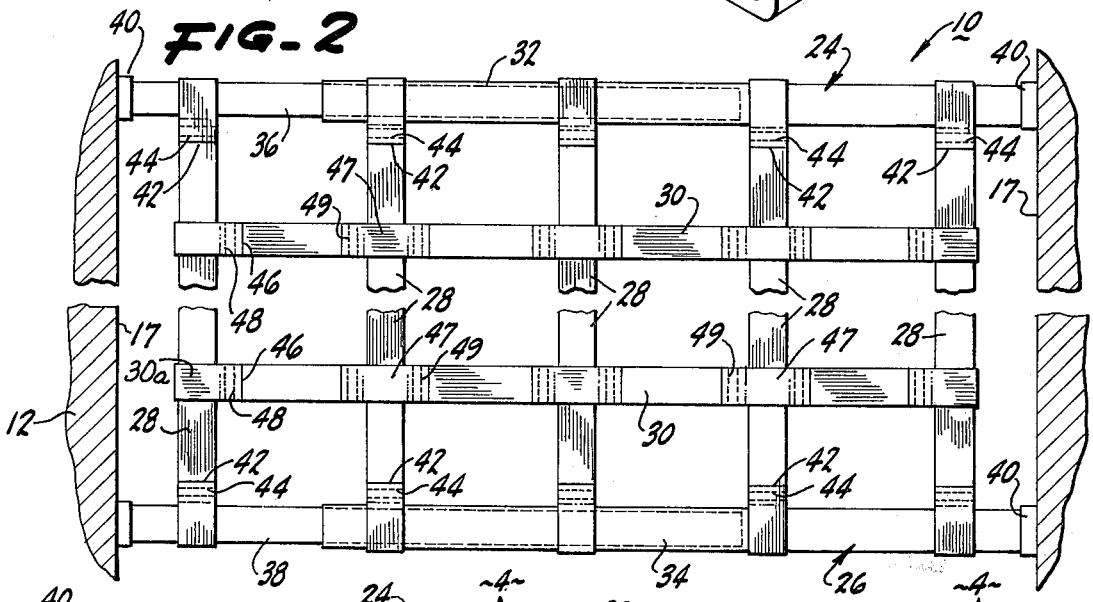
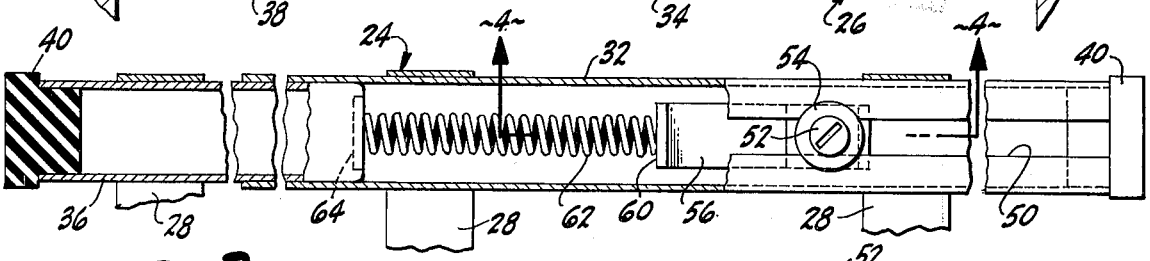
FIG-3
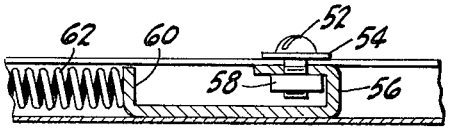
FIG-4

SHELF RETAINER FOR MOBILE VEHICLE REFRIGERATORS

BACKGROUND AND SUMMARY OF THE INVENTION

This invention relates to a device for retaining articles on the shelves of a refrigerator of the type used in mobile vehicles where the articles are subject to sudden or gradual displacements caused by motion of the vehicle. Refrigerators, particularly small compact refrigerators, are currently installed in a variety of mobile vehicles such as campers, vans, trailers, mobile or motor homes, and a variety of sailing or cruising boats. Often, such refrigerators are opened when the vehicle is in motion or is parked after having been in motion that has caused articles on the refrigerator shelves to be shifted against the door. The sudden and inadvertent displacement of the articles when the door of the refrigerator is opened is both anoying and inconvenient, particularly when items on the shelves are spilled out onto the floor. Additionally, in many refrigerators, shelves are arranged within a refrigeration compartment such that they are normally displaced from the inside wall of the refrigerator door providing a clearance. In such refrigerators, the articles on the shelves are subject of a back and forth displacement during rocking of the vehicle although the door remains shut. Such sudden or gradual displacements may cause articles supported on the shelves to be lodged in the clearance and to fall or spill when the door is opened.

The retainer device of this invention restricts the articles on the shelves from movement over the edges of the shelves both when the refrigerator door is shut and open. The device comprises a pair of elongated support members which are adjustable in length in order that they may be installed across the openings of refrigerators having different dimensions. The support members are telescopic and spring loaded such that the ends of the support members are mountable against the inside side walls of a refrigerator and retained in place by the expansion force of a compressed spring within the support members. Interconnecting the two support members are a plurality of spaced bands fabricated from an elastic material, such as elastic cloth webbing. The support members are horizontally mounted across the top and bottom of the refrigerator opening such that the spaced bands are vertically arranged and stretched against the front edge of the refrigerator shelves.

In addition to the vertical bands, a plurality of horizontal bands are included in the preferred embodiment to form a grid or web for retaining articles on the shelves which have shifted forward during motions of a vehicle. While these bands may also be elastic, it is preferred that they be fabricated of a less elastic cloth material for economy and simplicity. The horizontal bands are preferably, but not necessarily, slidably connected to the vertical bands when the retainer is installed in a refrigerator, such that the horizontal bands receive support from the vertical bands, yet are adjustable to optimum position for retaining articles on the shelves. The horizontal bands are connected at their ends to the two outermost vertical bands such that a grid is formed in front of the shelves by the bands and support members.

While the vertical bands may also be fabricated from a plain cloth material with satisfactory results, it is preferred that these bands be elastic to allow the retaining device to be adjustable within limits in the vertical direction, and to generate a firm retaining force against the front edges of the shelves. This will prevent the shelves from rattling and in those cases where the shelves are slidable, will prevent the shelves from displacing. Furthermore, the elastic nature of the vertical bands allows them to be manually stretched aside for removal of smaller items from the shelves without removing the retaining device from in front of the refrigerator opening.

It is contemplated that removal of larger items may require the removal of the retainer device, most conveniently by withdrawing and lowering the upper of the two support members.

While the retainer device may be oriented such that the two support members are vertically positioned, being mounted against the top and bottom inside surfaces of a refrigerator, the horizontal arrangement is preferred since the horizontal dimensions of refrigerators of this type are generally more consistent than the vertical dimensions and thus more compatible with the range of adjustment of the support members.

BRIEF DESCRIPTION OF THE DRAWINGS

FIG. 1 is a perspective view of the shelf retainer illustrated installed in a compact refrigerator.

FIG. 2 is a fragmentary front elevational view of the shelf retainer.

FIG. 3 is an enlarged fragmentary front elevational view, partially in cross section, illustrating the detail of a support member of the shelf retainer.

FIG. 4 is a fragmentary sectional view of the support member taken on the lines 4—4 in FIG. 3.

DETAILED DESCRIPTION OF THE PREFERRED EMBODIMENTS

Referring to FIG. 1, the article retainer designated generally by the reference numeral 10 is illustrated installed on a compact refrigerator 12 of the type customarily carried by mobile vehicles (not shown) such as campers, vans, trailers, mobile and motor homes, botas, and the like. The refrigerator 12 includes a plurality of shelves 14 carried on mounts 16 (one visible in FIG. 1) within a refrigeration compartment 15, defined by inside walls 17 and a door 18. The refrigerator 12 in FIg. 1 has the door 18 shown open permitting access through the open front of the refrigeration compartment to articles designated generally by the reference numeral 20, supported on the shelves 14.

The article retainer 10 is mounted in the front of the refrigerator against the front edges 22 of the shelves 14. The article retainer is constructed with two support members 24 and 26, respectively, which are mounted against the inside sidewalls 17 of the refrigerator 12. Connecting the upper and lower support members 24 and 26 are a plurality of spaced vertical bands 28, fabricated of an elastic material such as elastic cloth webbing. The support members 24 and 26 are horizontally arranged across the open refrigerator in an upper and lower parallel spaced manner such that the elastic bands 28 are stretched between the two support members against the front edges 22 of the shelves 14.

Horizontally arranged bands 30, fabricated from a cloth material, are connected at their ends **30*a* to the outermost vertical bands 28. These horizontal bands 30** are preferably positioned in front of the vertical bands 28 when the retainer device 10 is installed in the refrigerator 16, thereby gaining the lateral support of the elastic vertical bands 28.

The preferred manner of connecting the vertical bands 28 to the support members 24 and 26, and the horizontal bands 30 to the vertical bands 28 to form a grid is illustrated in FIG. 2. Referring to FIG. 2, the support members 24 and 26 are telescopically constructed with outer sleeve members 32 and 34 and inner slide members 36 and 38, respectively, enabling the support members to span the distance between the sidewalls 17 of the refrigerator, shown, as well as other refrigerators of differing dimensions. The support members have rubber-like shoes mounted at each end which abut the sidewalls 17.

The vertical bands 28 are connected to the support members 24 and 26 by looping the ends 42 of the bands over the support members and fastening the ends 42 to the body of the bands by stitching 44. Similarly, the ends 46 of the horizontal bands 30 are looped around the outermost of the vertical bands 28 and fastened to the body of the bands by stitching 48. Additionally, a plurality of short strips 47 are fastened by stitching 49 to the body of the bands 30 on each side of a vertical band as shown. It is preferred, but not necessary, that the vertical bands and the horizontal bands be loop stitched in the manner shown since this manner of fastening has the beneficial features of allowing the vertical bands to be uniformly adjusted along the length of the support members, regardless of the telescoped length of the support members, and allowing the horizontal bands to be vertically adjusted to the most effective position for retaining items on the refrigerator shelf.

The mechanism employed for adjusting the length of the support members 24 and 26 and for supporting the members against the sidewalls 17 of the refrigerator is shown in FIGS. 3 and 4.

Referring to FIGS. 3 and 4, the upper support member 24, shown as an exemplar of the two identically constructed members 24 and 26, has the inner slide member 36 telescopically inserted within outer sleeve member 32. The outer sleeve member 32 has a longitudinal slot 50 through which a locking bolt 52 is inserted. The locking bolt 52 is seated on a washer 54 and engages a sliding anchor bracket 56 within the sleeve member 32 fastening thereto by a nut 58. The anchor bracket 56 has an end tab 60 fixed to one end of a compression spring 62, as shown also in FIGS. 3 and 4. The opposite end of the compression spring 62 abuts the closed end 64 of the slide member 36, as shown in FIG. 3.

By loosening the bolt 52, the telescopic position of the sleeve member 32 and slide member 36 can be adjusted by movement of the anchor bracket 56 and compression spring 62. For proper support, the adjusted length, without compression of the spring 62, should be approximately an inch longer than the span across which the support members are mounted.

The bolt 52 is then tightened thereby fixing the position of the anchor bracket 56. By forcing the slide member 36 in the sleeve member 32, thereby compressing the compression spring, the effective length of the support member is reduced. The support member can thus be positioned between the sidewalls 17 of the refrigerator and released. The expansion force of the compression springs acts on the inserted shoes 40 on the ends of the support members and the sidewalls to hold the support members, by force of friction, in position.

While in the foregoing specification, embodiments of the invention have been set forth in considerable detail for the purposes of making a complete disclosure thereof, it will be apparent to those skilled in the art that numerous changes may be made in such details without departing from the spirit and principles of the invention.

What is claimed is:

1. In a mobile refrigerator having, in combination, a refrigeration compartment defined by inside walls, an open front, and a door affording access to the refrigeration compartment through the open front, the compartment having at least one shelf for supporting removable articles thereon, the improvement comprising: an article retaining device including:

a. first elongated adjustable cross-member mounted between the sidewalls;

b. second elongated adjustable cross-member mounted between the sidewalls, and below and parallel to said first cross-member; each of said cross-members comprising a sleeve member and a slide member with an end telescopically inserted in said sleeve member;

c. means for horizontally mounting said crossmembers between the sidewalls comprising an anchor bracket slidably connected to said sleeve member; locking means for selectively fixing said anchor bracket to said sleeve member; a compression spring having a first end contacting said anchor bracket and a second end contacting the end of said slide member said compression spring being compressible between said anchor bracket and the end of said slide member, said cross-members having opposite ends which are forced against said opposing sidewalls when said compression spring is compressed, and;

d. a web comprising a plurality of elastic vertical bands and a plurality of horizontal bands, said plurality of vertical bands each having first ends connected to said first cross-member and second ends connected to said second cross-member.

2. The article retaining device of claim 1 wherein said plurality of horizontal bands are slidably connected to said plurality of vertical bands.

* * * * *